US009702638B2

(12) United States Patent
Cecil, Jr. et al.

(10) Patent No.: US 9,702,638 B2
(45) Date of Patent: Jul. 11, 2017

(54) FRAME FOR A HEAT EXCHANGER

(71) Applicant: SPX CORPORATION, Charlotte, NC (US)

(72) Inventors: James A. Cecil, Jr., Goldsboro, NC (US); Derek Ian Finch, Goldsboro, NC (US); James Schuyler Good, Clayton, NC (US)

(73) Assignee: SPX FLOW TECHNOLOGY SYSTEMS, INC., Getzville, NY (US)

( * ) Notice: Subject to any disclaimer, the term of this patent is extended or adjusted under 35 U.S.C. 154(b) by 174 days.

(21) Appl. No.: 14/802,306

(22) Filed: Jul. 17, 2015

(65) Prior Publication Data

US 2017/0016683 A1 Jan. 19, 2017

(51) Int. Cl.
*F28F 7/00* (2006.01)
*F28F 3/08* (2006.01)

(52) U.S. Cl.
CPC ..... *F28F 3/083* (2013.01); *F28F 2275/08* (2013.01); *F28F 2280/00* (2013.01)

(58) Field of Classification Search
CPC ..... F28F 3/083; F28F 2275/08; F28F 2280/00
USPC ..... 165/76
See application file for complete search history.

(56) References Cited

U.S. PATENT DOCUMENTS 5,775,119 A * 7/1998 Yamada ..... F24F 1/06 312/100
2004/0200598 A1* 10/2004 Hitt ..... B60K 11/04 165/69
2007/0039472 A1* 2/2007 Bias ..... B03C 3/025 96/66
2007/0125525 A1* 6/2007 Heine ..... F28F 9/002 165/121
2015/0000321 A1* 1/2015 Kagawa ..... F25D 21/00 62/291

* cited by examiner

*Primary Examiner* — Davis Hwu
(74) *Attorney, Agent, or Firm* — Baker and Hostetler LLP

(57) ABSTRACT

A frame for a plate heat exchanger includes a head and a follower, a plurality of rib assemblies, and a plurality of tie bar assemblies. Each of the head and the follower includes a plurality of interlocking rib cutouts. Each rib assembly includes a pair of ribs. Each rib includes a first grip disposed at a first end of the rib, a second grip disposed at a second end of the rib, a first cradle disposed at the first end of the rib, and a second cradle disposed at the second end of the rib. Both the first cradle and the second cradle include a cradle bearing surface. Each tie bar assembly includes a tie bar, a nut, and a tie bar bearing surface to bear upon the cradle bearing surface.

20 Claims, 7 Drawing Sheets

FRAME FOR A HEAT EXCHANGER

FIELD OF THE INVENTION

The present invention relates generally to a plate heat exchanger. More particularly, the present invention relates to a frame assembly for use on a plate heat exchanger.

BACKGROUND OF THE INVENTION

It is generally known that plate heat exchangers offer efficient transfer of heat from one fluid to another in a relatively small volume. Heat exchangers are typically assembled from a multitude of individual or welded pairs of plates called a plate pack that are sealed around an outer edge with a gasket material. The plate pack is compressed in a frame of the heat exchanger in order to form the seal between the plates or plate pairs.

The compression is applied uniformly across the surface of the plate pack in order to prevent leakage from the seal and reduce damage to the plates. Because of the size of the plate pack and the amount of pressure applied, the plate pack is sandwiched between two thick metal pressure plates called the head and follower that are used to distribute the load evenly.

In fact, the head and follower of large heat exchangers may be very large. Due to the amount of metal, the head and follower are expensive to make and ship, difficult to machine, and inconvenient to work with. Unfortunately, no conventional heat exchangers address these issues.

Accordingly, there is a need for reducing expense and the weight of the head and follower of a heat exchanger to address the problems described above and/or problems posed by other conventional approaches.

SUMMARY OF THE INVENTION

Embodiments of the present disclosure are capable of reducing the weight of the head and follower of a heat exchanger, at least to some extent.

An embodiment of the invention pertains to a frame for a plate heat exchanger. The frame includes a head and a follower, a plurality of rib assemblies, and a plurality of tie bar assemblies. Each of the head and the follower includes a plurality of interlocking rib cutouts. Each rib assembly includes a pair of ribs. Each rib includes a first grip disposed at a first end of the rib, a second grip disposed at a second end of the rib, a first cradle disposed at the first end of the rib, and a second cradle disposed at the second end of the rib. Both the first cradle and the second cradle include a cradle bearing surface. Each tie bar assembly includes a tie bar, a nut, and a tie bar bearing surface to bear upon the cradle bearing surface.

Another embodiment of the invention relates to a plate heat exchanger. The plate heat exchanger includes a plate pack and frame. The plate pack has a first inlet for a first fluid, a first outlet for the first fluid, a second inlet for a second fluid, and a second outlet for the second fluid. The plate pack is configured to direct a flow of the first fluid in thermal contact and exchange heat with a flow of the second fluid. The frame includes a head and a follower, a plurality of rib assemblies, and a plurality of tie bar assemblies. Each of the head and the follower includes a plurality of interlocking rib cutouts. Each rib assembly includes a pair of ribs. Each rib includes a first grip disposed at a first end of the rib, a second grip disposed at a second end of the rib, a first cradle disposed at the first end of the rib, and a second cradle disposed at the second end of the rib. Both the first cradle and the second cradle include a cradle bearing surface. Each tie bar assembly includes a tie bar, a nut, and a tie bar bearing surface to bear upon the cradle bearing surface.

Yet another embodiment of the invention relates to a method of compressing a plate pack in a frame of a plate heat exchanger. In this method, the plate pack is disposed between a head and a follower. Each of the head and the follower includes a plurality of interlocking rib cutouts. A plurality of rib assemblies are disposed on an outside face of the head and a corresponding plurality of rib assemblies on an outside face of the follower in cooperative alignment with the plurality of rib assemblies on the outside face of the head. Each rib assembly includes a pair of ribs. Each rib includes a first grip disposed at a first end of the rib, a second grip disposed at a second end of the rib, a first cradle disposed at the first end of the rib, and a second cradle disposed at the second end of the rib. Both the first cradle and the second cradle include a cradle bearing surface. The plate pack is compressed between the head and the follower with a plurality of tie bar assemblies. Each tie bar assembly includes a tie bar, a nut, and a tie bar bearing surface to bear upon the cradle bearing surface. The plate pack is compressed between the head and the follower by tightening the nut of each tie bar assembly.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The drawings presented are intended solely for the purpose of illustration and therefore, are neither desired nor intended to limit the subject matter of the disclosure to any or all of the exact details of construction shown, except insofar as they may be deemed essential to the claims.

DETAILED DESCRIPTION OF PREFERRED EMBODIMENTS OF THE INVENTION

In general, embodiments of the invention pertain to a heat exchanger with a head and follower that weigh less and offer cost savings over conventional heat exchanger heads and followers and a method of assembling a frame of the heat exchanger with the reduced weight head and follower. In addition to a decrease in material cost of the ribbed head and follower described herein, costs are reduced by not welding the parts together. Increased costs associated with welding include: cost of skilled welders; welding equipment; welding consumable; cost of repairing cracked welds; radiographic inspection of the welds; costs associated with distortion of the welded parts; and the like. By assembling a ribbed head and follower without welds, these costs can be removed and the weight can be reduced.

Figure 1:
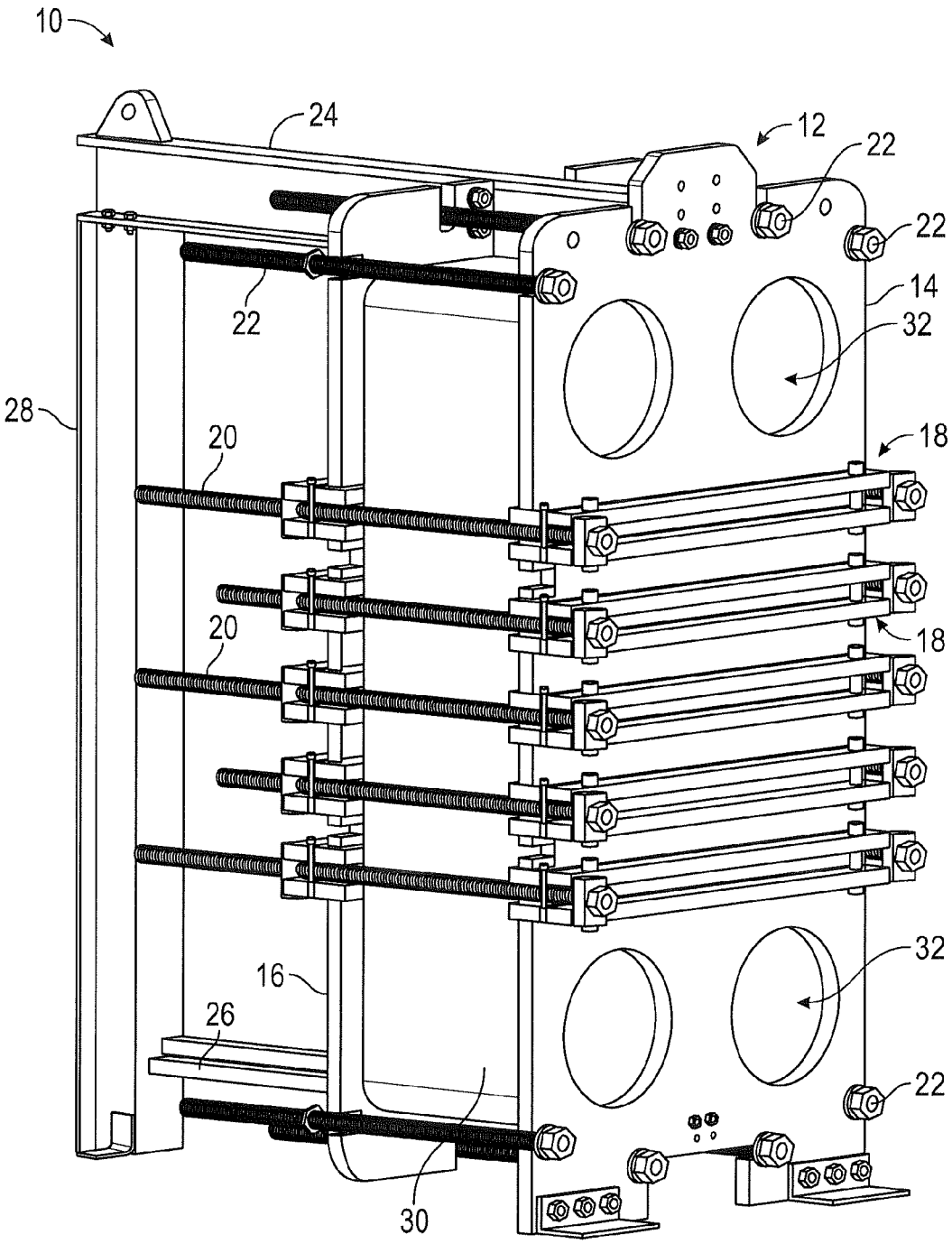
FIG. 1 is a perspective view of a heat exchanger suitable for use with embodiment of the invention.

Referring now to the figures wherein like reference numerals indicate like elements, in FIG. 1 is a perspective view of a heat exchanger 10 suitable for use with embodiment of the invention. As shown in FIG. 1, the heat exchanger 10 includes a frame 12 having a head 14, a follower 16, a plurality of rib assemblies 18, a plurality of tie bar assemblies 20, a plurality of auxiliary tie bars 22, a top bar 24, a bottom bar 26, and an end support 28. The frame 12 is configured to retain and compress a plate pack 30. To circulate fluids through the plate pack 30, the heat exchanger 10 includes a plurality of ports 32.

As described herein, the plurality of rib assemblies 18 interlock with the head 14 and follower 16 to distribute a compressive load across the head 14 and follower 16. This load is imparted on the plurality of rib assemblies 18 via the plurality of tie bar assemblies 20 that interlock at opposite ends of the plurality of rib assemblies 18. As described herein, the plurality of tie bar assemblies 20 may pivot relative to the plurality of rib assemblies 18. This pivoting at the interface between the tie bar assemblies 20 and the rib assemblies 18 are described in greater detail hereinbelow. Optionally, the plurality of auxiliary tie bars 22 are configured to exert a compressive force drawing the head 14 and follower 16 together at areas where the rib assemblies 18 may not be appropriate such as close to or across the ports 32.

In general, the heat exchanger 10 includes the frame 12 and the plate pack 30. The frame 12 is assembled from the various components of the frame 12. In the particular example shown in FIG. 1, the frame 12 is assembled by securing the head 14 to the top bar 24 and the bottom bar 26. The end support 28 is also secured to the top bar 24 and the bottom bar 26. The follower 16 is suspended in the top bar 24 and slides or rolls (via rollers—not shown) on the top bar 24. The follower 16 is guided by the bottom bar 26. The plate pack 30 is supported via the top bar 24 and/or the bottom bar 26. When drawn toward the head 14, the follower 16 slides/rolls along the top bar 24 and the plate pack 30 is compressed there between.

Figure 2:
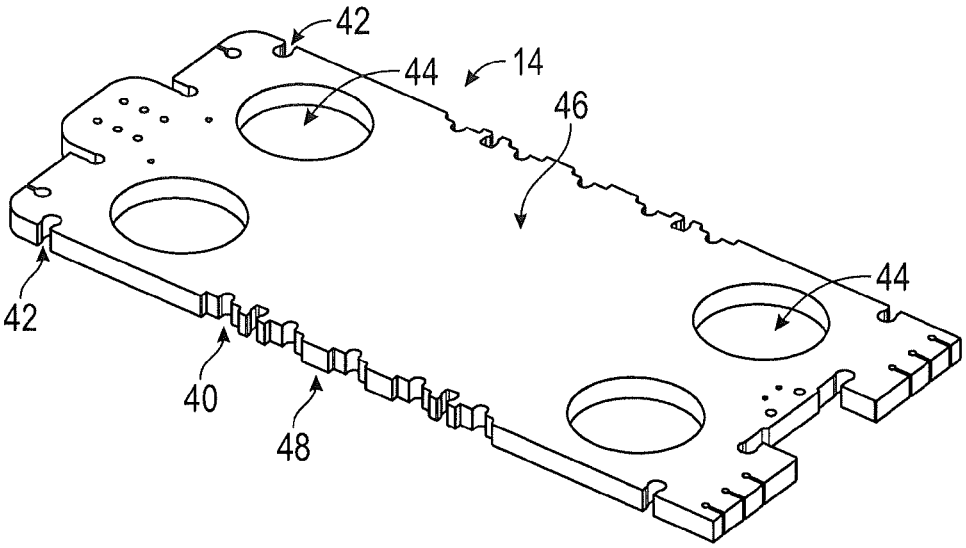
FIG. 2 is a perspective view of a head in accordance with an embodiment of the invention.

FIG. 2 is a perspective view of the head 14 in accordance with an embodiment of the invention. As shown in FIG. 2, the head 14 includes a plurality of interlocking rib cutouts 40, a plurality of auxiliary tie bar cutouts 42, and a plurality of port cutouts 44. In addition, the head 14 includes a first face 46 and a second face 48. The plurality of interlocking rib cutouts 40 are configured to mate with ends of the rib assemblies 18 and secure them. While the interlocking rib cutouts 40 are shown in a stepped configuration, in other examples, the interlocking rib cutouts 40 may be square, rectangular U-shape, or the like. The plurality of auxiliary tie bar cutouts 42 are configured to mate with ends of the auxiliary tie bars 22. As shown in FIG. 1, the plurality of interlocking rib cutouts 40 on the head 14 are in cooperative alignment with the plurality of interlocking rib cutouts 40 on the follower 16 and the plurality of auxiliary tie bar cutouts 42 are in cooperative alignment with the plurality of auxiliary tie bar cutouts 42 on the follower 16.

Returning to FIG. 2, the plurality of port cutouts 44 are configured to provide access to fluid couplings (not shown) for the flow of fluid through the plate pack 30. The first face 46 is configured to provide a bearing surface for the rib assemblies 18. The second face 48 is configured to provide a bearing surface for the plate pack 30. Of note, the follower 16 is similar to the head 14 in that it also includes the plurality of interlocking rib cutouts 40, the plurality of auxiliary tie bar cutouts 42, the first face 46, and the second face 48. However, in some examples, the follower 16 may not include the port cutouts 44. In addition, the follower 16 and/or the plate pack 30 may include a top bar cutout (not shown) and/or a bottom bar cutout (not shown). While these elements are not explicitly shown, they are well understood.

Figure 3:
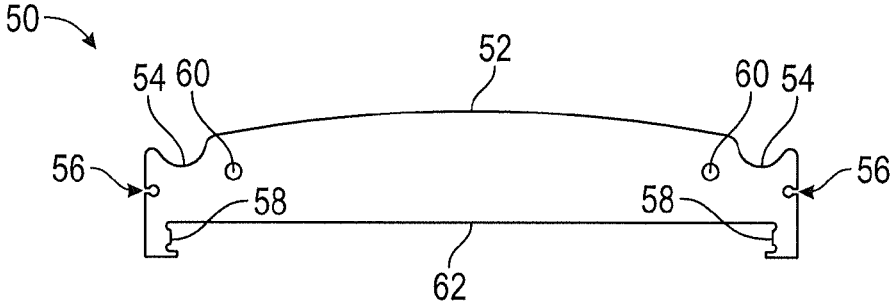
FIG. 3 is a side view of a rib in accordance with an embodiment of the invention.

FIG. 3 is a side view of a rib 50 in accordance with an embodiment of the invention. According to various embodiments, and as shown herein, each rib assembly 18 (shown in FIG. 1) includes a pair of the ribs 50. As shown in FIG. 3, the rib 50 includes a rib arc 52, a pair of cradles 54, a pair of locking pin cutouts 56, a pair of grips 58, a pair of rib spacer bores 60, and a pair of contact surfaces 62. The rib arc 52 generally defines a profile of the rib 50. In this manner, the rib 50 may be relatively taller at a middle portion to better distribute a load across the head 14 or follower 16.

Figure 8:
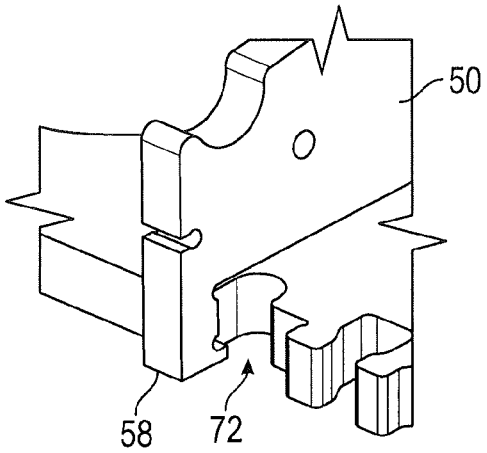
FIG. 8 is a perspective view of the interlocking rib cutout and the rib in a partially assembled state in accordance with an embodiment of the invention.
Figure 9:
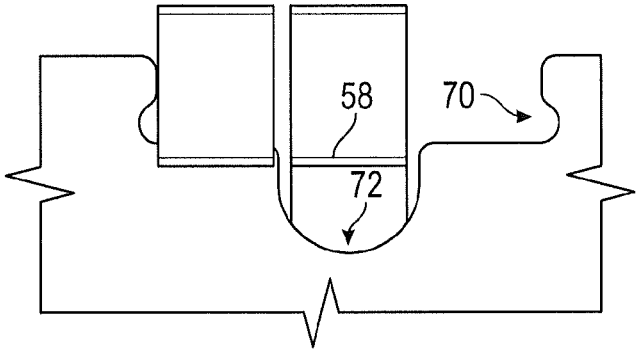
FIG. 9 is a bottom view of the interlocking rib cutout and a first rib in the fully assembled position and a second rib in the partially assembled state in accordance with an embodiment of the invention.
Figure 10:
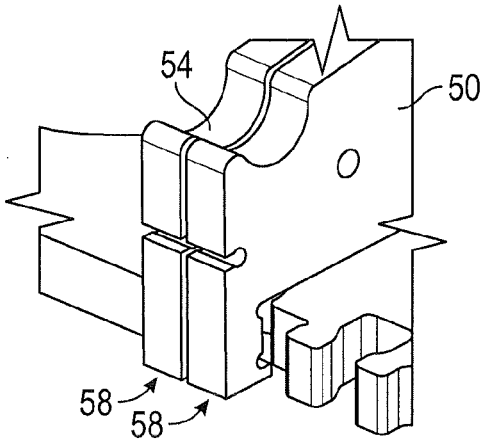
FIG. 10 is a perspective view of the interlocking rib cutout and a first rib in the fully assembled position and a second rib in the partially assembled state in accordance with an embodiment of the invention.
Figure 11:
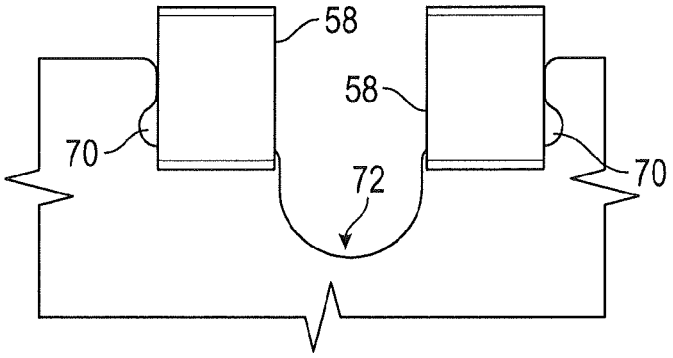
FIG. 11 is a bottom view of the interlocking rib cutout and two ribs in their fully assembled positions in accordance with an embodiment of the invention.
Figure 12:
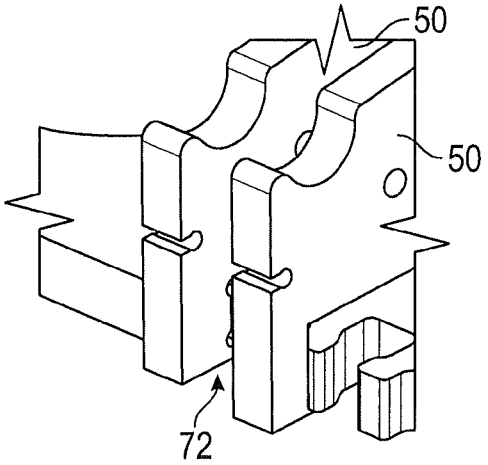
FIG. 12 is a perspective view of the interlocking rib cutout and two ribs in their fully assembled positions in accordance with an embodiment of the invention.
Figure 16:
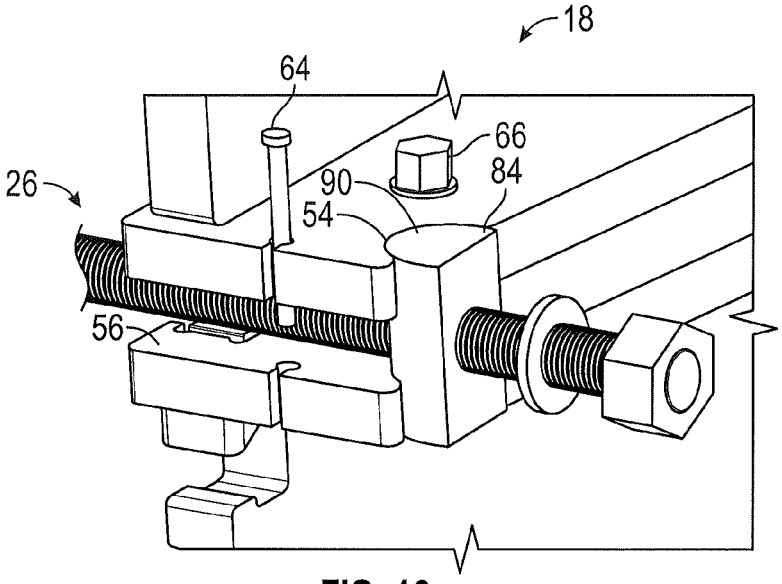
FIG. 16 is a perspective view of one end of a tie bar assembly being secured in a rib assembly in accordance with an embodiment of the invention.
Figure 17:
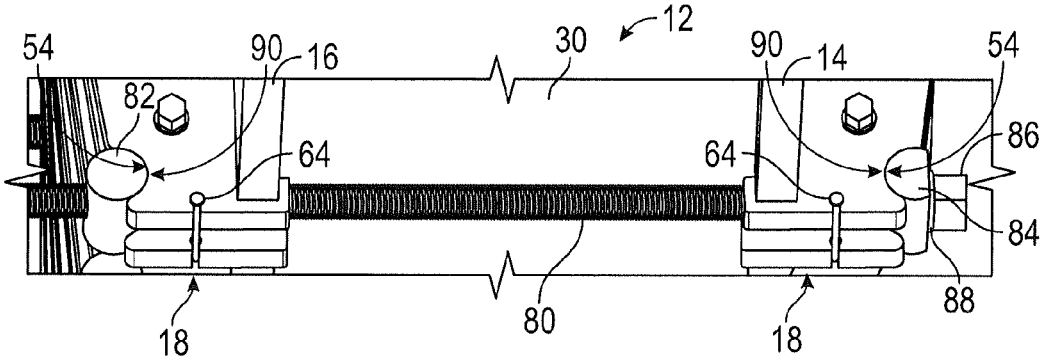
FIG. 17 is a perspective view of a portion of an assembled frame in accordance with an embodiment of the invention.

The cradle 54 is configured to provide a bearing surface for the tie bar assembly 20 as shown in FIGS. 16 and 17. As used herein, the term, bearing surface refers generally to any suitable surface for bearing a load. Examples of suitable surfaces include relatively hard and/or tough surfaces such as metal or polymer and may be polished, coated, and/or may include a friction reducing element such a race for a ball or roller bearing component. The profile of the cradle 54 generally facilitates retaining the tie bar assembly 20 when under load and also provides for rotation of the tie bar assembly 20. The locking pin cutout 56 is configured to mate with a locking pin 64 (shown in FIGS. 16 and 17) to secure the tie bar assembly 20 to the rib assembly 18 (also shown in FIGS. 16 and 17). The grip 58 is configured to mate with the interlocking rib cutouts 40 to secure the rib 50 to the head 14 or follower 16. As seen more clearly in FIG. 8, the grip 58 may wrap around the head 14 and follower 16 to secure the rib 50 to the head 14 and follower 16. Returning to FIG. 3, the rib spacer bore 60 is configured to mate with a rib spacer bolt 66 (shown in FIG. 13) to secure a rib spacer 68 between the pair of ribs 50 (shown in FIG. 13). The contact surface 62 is configured to mate with the first face 46 of either the head 14 or follower 16. In various examples, the contact surface 62 may be flat or, to facilitate more efficient load distribution across the first face 46, slightly curved or crowned.

Figure 4:
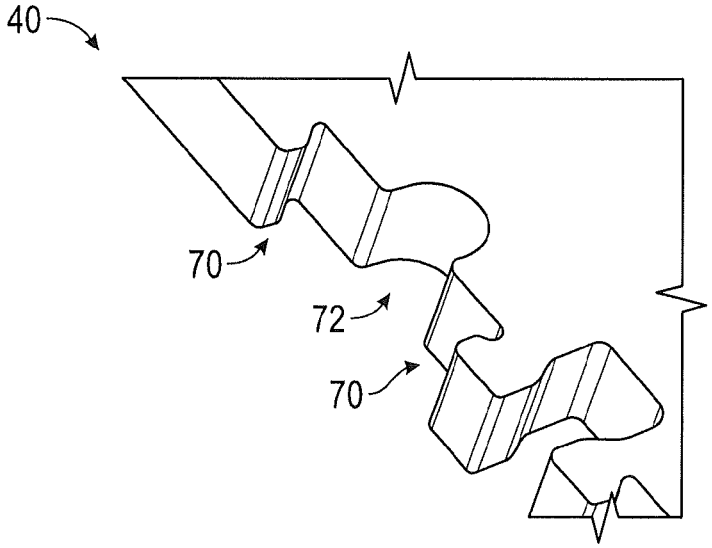
FIG. 4 is a perspective view of an interlocking rib cutout in accordance with an embodiment of the invention.
Figure 5:
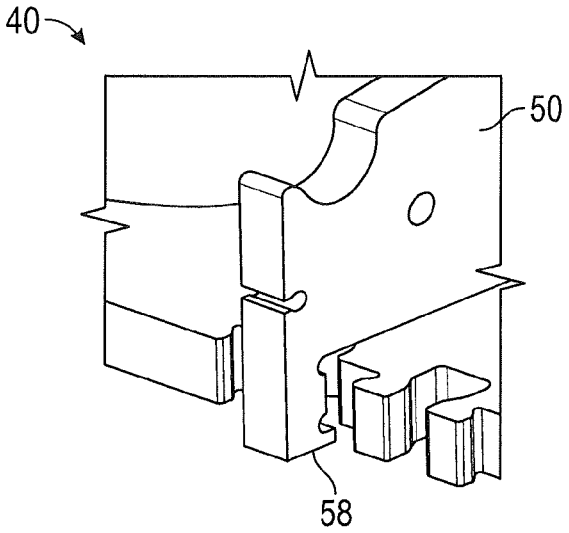
FIG. 5 is a perspective view of the interlocking rib cutout and the rib in a partially assembled state in accordance with an embodiment of the invention.
Figure 6:
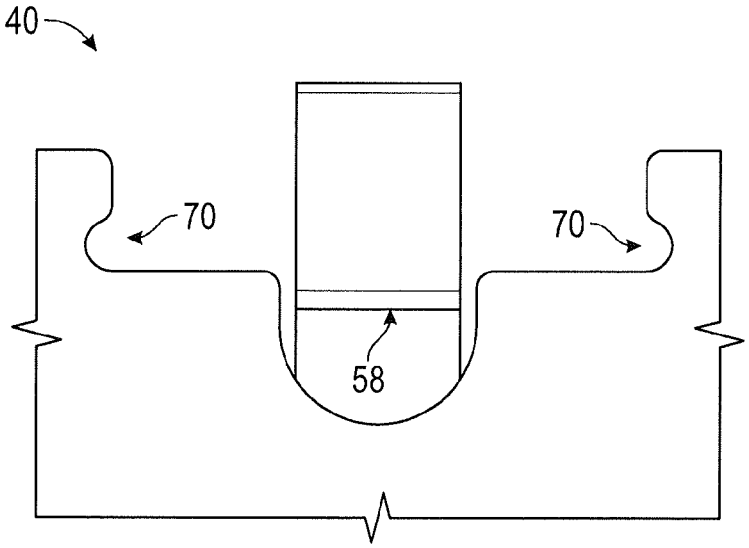
FIG. 6 is a bottom view of the interlocking rib cutout and the rib in a partially assembled state in accordance with an embodiment of the invention.
Figure 7:
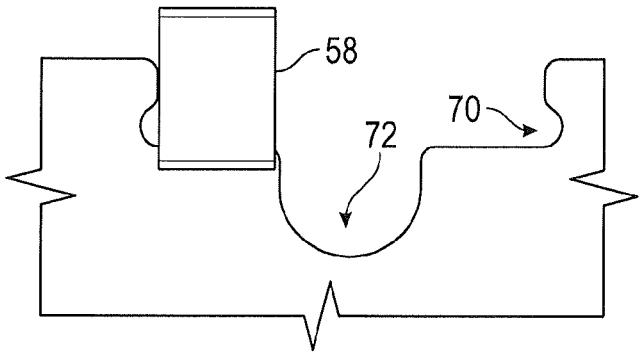
FIG. 7 is a bottom view of the interlocking rib cutout and the rib in a partially assembled state in accordance with an embodiment of the invention.

FIG. 4 is a perspective view of the interlocking rib cutout 40 in accordance with an embodiment of the invention. As shown in FIG. 4, the interlocking rib cutout 40 includes a pair of mating portions 70 and a tie bar cutout 72. As shown in the series of FIGS. 5-12, the ribs 50 are arranged on the head 14 or follower 16 by introducing the grip 58 to the interlocking rib cutout 40 at the tie bar cutout 72 and then sliding the rib 50 over to one side such that the grip 58 engages with the mating portion 70 (see FIGS. 5-8). Thereafter, the second rib 50 is introduced in the same manner and slid to the other side of the interlocking rib cutout 40 to engage the grip 58 with the mating portion 70 (see FIGS. 9-12).

Figure 13:
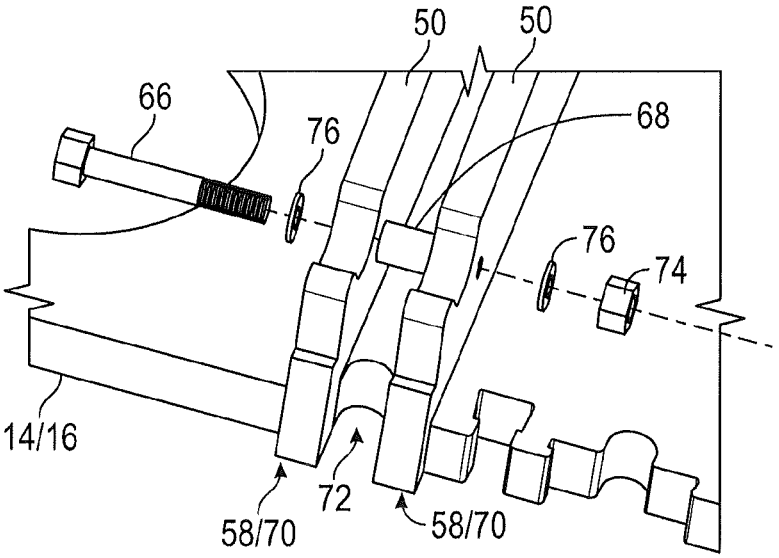
FIG. 13 is a perspective view of the interlocking rib cutout and two ribs in their fully assembled positions and the rib fastening hardware at one end of the rib in accordance with an embodiment of the invention.

FIG. 13 is a perspective view of the interlocking rib cutout 40 and the rib 50 in a partially assembled state in accordance with an embodiment of the invention. In general, by securing the ribs 50 to the head 14 or follower 16 and securing the pair of ribs 50 together, load applied to the cradles 54 is distributed across the first face 46 and the mating edges of the two ribs 50. As shown in FIG. 13, the ribs 50 are retained in place on the head 14 or follower 16 by securing the rib spacer 68 between the ribs 50. That is, by preventing the grip 58 from moving into the tie bar cutout 72, the grip 58 is captured in the interlocking rib cutout 40. In the example shown, the rib spacer 68 is a cylinder with a sufficiently large inner bore to allow the rib spacer bolt 66 to pass therethrough. In addition, the rib spacer 68 includes an outer diameter that is greater than the diameter of the rib spacer bore 60. The ends of the rib spacer 68 serve as bearing surfaces upon which the insides of the ribs 50 bear. To secure the rib spacer bolt 66, a rib spacer nut 74 may be screwed onto a threaded end of the rib spacer bolt 66. Optionally, one or more rib spacer washers 76 may be included.

Figure 14:
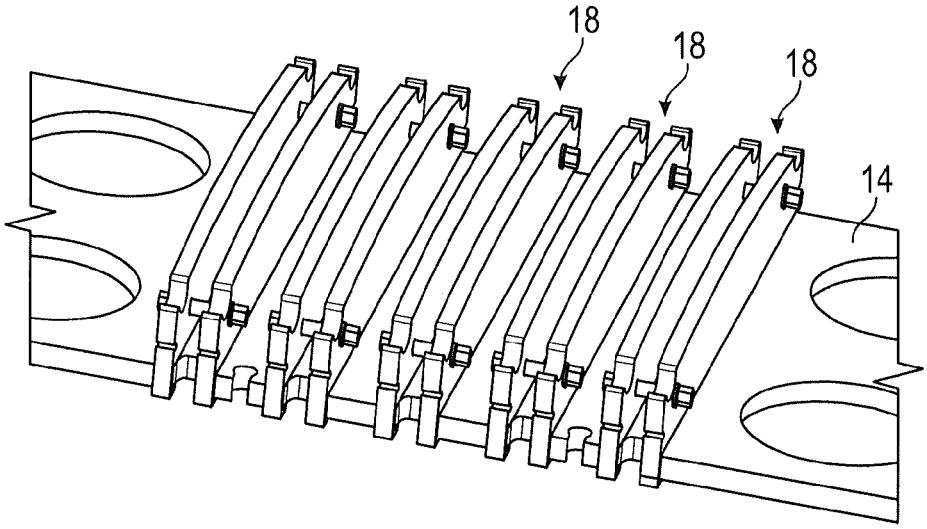
FIG. 14 is a perspective view of a rib assembly set assembled to the head in accordance with an embodiment of the invention.

FIG. 14 is a perspective view of the rib assemblies 18 in an assembled state in accordance with an embodiment of the invention. As shown in FIG. 14, a series or array of pairs of the rib assemblies 18 may be secured to the head 14 and follower 16. In this manner, the load applied via the tie bar assemblies 20 (shown in FIGS. 1, 16, and 17) may be distributed across and along the head 14 and follower 16.

Of note, while the rib assemblies 18 are shown as pairs of the ribs 50, in other examples the rib assemblies 18 may be a single rib 50. For example, the ribs 50 may include "Y" or "U" shaped ends to accept the tie bar assemblies 20.

Figure 15:
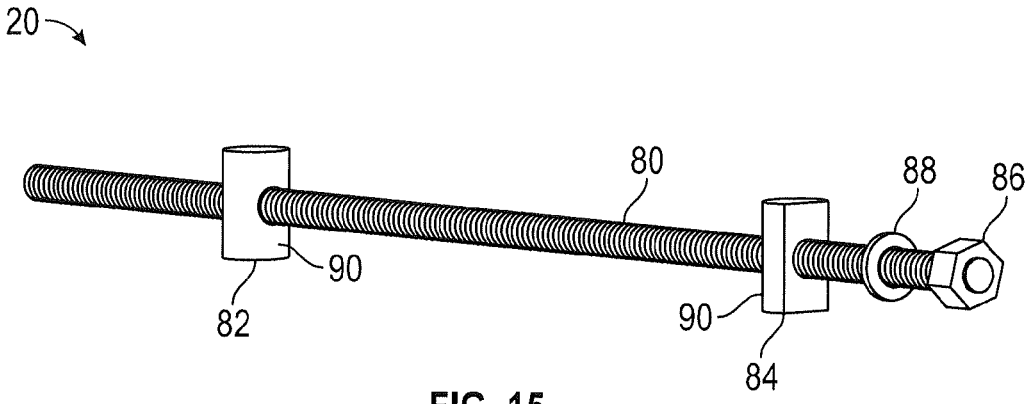
FIG. 15 is a perspective view of a tie bar assembly in accordance with an embodiment of the invention.

FIG. 15 is a perspective view of the tie bar assembly 20 in accordance with an embodiment of the invention. As shown in FIG. 15, the tie bar assembly 20 includes a tie bar 80, a tightening nut 82, a location washer 84, nut 86, and a thrust washer 88. The tie bar 80 may be fully threaded or threaded along a portion to engage the tightening nut 82. The location washer 84 includes a bore to capture the tie bar and the location washer 84 is configured to slide relative to the tie bar 80. In various examples, the nut 86 is configured to thread onto the tie bar 80 or may be locked onto the end of the tie bar 80. In the particular example shown, the nut 86 is locked on the end of the tie bar 80 such that rotation of the nut 86 urges the tie bar 80 to rotate. To lock the nut 86 on the tie bar 80, the nut 86 may be affixed, crimped, or welded to the tie bar 80. The thrust washer 88 is configured to transfer thrust from the nut 86 to the location washer 84. In general, the thrust washer 88 eases rotation of the tie bar 80 and reduces wear and/or binding.

Both the tightening nut 82 and location washer 84 include a bearing surface 90 to mate with and bear upon the cradle 54. In order to allow the rib assembly 18 and tie bar assembly 20 to pivot relative to one another, the bearing surfaces 90 may be round to match a radius of the cradle 54 (shown in FIGS. 16, 17). The cradles 54 enable both the tightening nut 82 and location washer 84 to rotate about their own axes to overcome the usual inclination of the flat mating surface to conform to the curvature of the head and follower as they are tightened (thus bending the tie bar 80). If the tie bar 80 were allowed to bend, the threads of the tightening nut 82 would experience an uneven load from one side to the other which would greatly increase turning resistance. To compensate, an increased torque would need to be applied to achieve the same amount of compression in the plate pack 30. The rounded shape of the bearing surface 90 reduces or prevents this bending of the tie bar 80 by allowing the tightening nut 82 and location washer 84 to rotate about their own axes. In other examples, the tightening nut 82 and/or location washer 84 may include a bearing assembly such as a ball bearing and/or roller bearing in order to facilitate rotation at the cradle 54/bearing surface 90 interface.

FIG. 16 is a perspective view of tie bar assembly 20 being secured in the rib assembly 18 in accordance with an embodiment of the invention. As shown in FIG. 16, the tie bar assembly 20 is secured in the rib assembly 18 via the locking pin 64 being disposed in the locking pin cutout 56. In this manner, the tie bar assembly 20 may be secured in the rib assembly 18 during assembly of the frame 12 and compression of the plate pack 30.

FIG. 17 is a perspective view of a portion of the assembled frame 12 in accordance with an embodiment of the invention. As shown in FIG. 17, the frame 12 is configured to compress the plate pack 30 between the head 14 and follower 16. More particularly, in response to rotating the nut 86, the tie bar 80 is urged to rotate relative to the tightening nut 82. In the particular example shown, a clockwise rotation of the tie bar 80 relative to the tightening nut 82 translates the tightening nut 82 toward the location washer 84. This action reduces the space between the tightening nut 82 and the location washer 84. Thrust from the tightening nut 82 is translated via the cradle 54 to the rib assembly 18 on the follower 16 and, from there to the plate pack 30. Thrust from the nut 86 is translated to the thrust washer 88 to the location washer 84 to the cradle 54 of the rib assembly 18 on the head 14 and, from there, to the plate pack 30.

In FIGS. 1-17, the ribs 50 are shown with grips 58 and the head 14/follower 16 are shown with interlocking rib cutouts 40. However, in other examples the grips 58 and/or interlocking rib cutouts 40 may be omitted. For example, the interlocking rib cutouts 40 may be omitted and the ribs 50 may be slid into position from one end or the other and held in place with bolts, pins, straps, clamps, or the like. In another example, the grips 58 may be omitted and the interlocking rib cutouts 40 may be utilized to locate the tie bar 80. In yet another example, both the grips 58 and the interlocking rib cutouts 40 may be omitted and, again, the ribs 50 may be held in place with bolts, welded on lugs, pins, straps, clamps, or the like.

Figure 18:
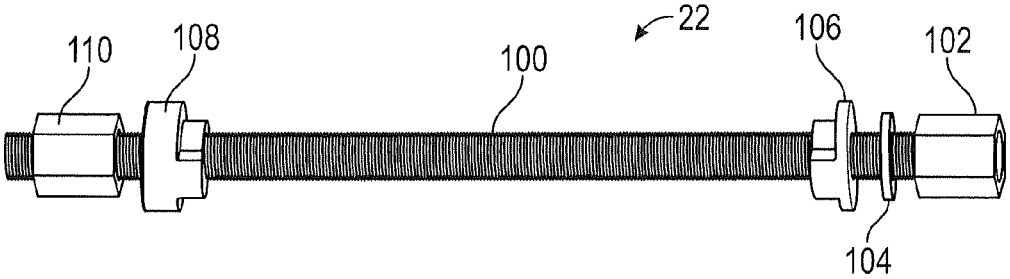
FIG. 18 is a perspective view of an auxiliary tie bar assembly in accordance with an embodiment of the invention.

FIG. 18 is a perspective view of an auxiliary tie bar assembly 22 in accordance with an embodiment of the invention. As shown in FIG. 18, the auxiliary tie bar assembly 22 includes a tie bar 100, fixed nut 102, thrust washer 104, location washer 106, anti-rotation collar 108, and a tightening nut 110. The operation of the auxiliary tie bar assembly 22 is similar to that of the tie bar assembly 20 and thus, for the sake of brevity, those items described above will not be described again. A difference between the auxiliary tie bar assembly 22 and the tie bar assembly 20 is that the location washer 106 and anti-rotation collar 108 are configured to directly mate with the head 14 and follower 16 via the auxiliary tie bar cut outs 42 (shown in FIGS. 1 and 2). That is, the location washer 106 mates with the auxiliary tie bar cut out 42 disposed on the head 14 and the anti-rotation collar 108 mates with the auxiliary tie bar cut out 42 disposed on the follower 16. These elements then bear upon the respective head 14 and follower 16 in response to rotation of the tie bar 100

In this manner, the plate pack 30 may be compressed at areas where a rib assembly 18 may not fit due to other elements of the heat exchanger 10 such as the ports 32, for example.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A frame for a plate heat exchanger, the frame comprising:
- a head and a follower, each of the head and the follower including:
  - a plurality of interlocking rib cutouts;
- a plurality of rib assemblies, each rib assembly including:
  - a pair of ribs, each rib including: a first grip disposed at a first end of the rib; a second grip disposed at a second end of the rib; a first cradle disposed at the first end of the rib; and a second cradle disposed at the second end of the rib, wherein both the first cradle and the second cradle include a cradle bearing surface; and
- a plurality of tie bar assemblies, each tie bar assembly including:
  - a tie bar;
  - a nut; and
  - a tie bar bearing surface to bear upon the cradle bearing surface.

2. The frame according to claim 1, wherein each rib assembly further comprises:
- a spacer bush;
- a spacer bolt; and
- a pair of spacer bolt bores disposed in cooperative alignment through the pair of ribs.

3. The frame according to claim 1, wherein each rib further comprises:
- a plate bearing surface configured to bear upon an outside surface of the head or the follower.

4. The frame according to claim 1, further comprising:
- a pair of pin cutouts disposed in cooperative alignment through the pair of ribs; and
- a pin configured to mate with the pair of pin cutouts to capture a tie bar between the pair of ribs.

5. The frame according to claim 1, wherein each tie bar assembly further comprises:
- a tightening nut having a threaded bore to mate with a threaded portion of the tie bar and the tightening nut having the tie bar bearing surface to bear upon the cradle bearing surface; and
- a location washer having an unthreaded bore for sliding communication with the tie bar and the location washer having the tie bar bearing surface to bear upon the cradle bearing surface.

6. The frame according to claim 1, wherein each of the head and the follower further comprises:
- a first interlocking cutout disposed at a first portion of the interlocking rib cutout, the first interlocking cutout being configured to mate with the first grip;
- a second interlocking cutout disposed at a second portion of the interlocking rib cutout, the second interlocking cutout being configured to mate with the second grip; and
- a tie bar cutout disposed between the first interlocking cutout and the second interlocking cutout, the tie bar cutout being configured to provide a passage for the tie bar.

7. The frame according to claim 1, wherein each of the head and the follower further comprises:
- a top tie bar cutout disposed at a top portion of the head and the follower, the top tie bar cutout being in cooperative alignment and configured to mate with respective mating surfaces of a top tie bar; and
- a bottom tie bar cutout disposed at a bottom portion of the head and the follower, the bottom tie bar cutout being in cooperative alignment and configured to mate with respective mating surfaces of a bottom tie bar.

8. The frame according to claim 7, wherein each of the head and the follower further comprises:
- a top side bar cutout disposed proximal to the top portion of the head and the follower, the top side tie bar cutout being in cooperative alignment and configured to mate with respective mating surfaces of a top side tie bar; and
- a bottom side tie bar cutout disposed proximal to the bottom portion of the head and the follower, the bottom side tie bar cutout being in cooperative alignment and configured to mate with respective mating surfaces of a bottom side tie bar.

9. A plate heat exchanger comprising:

a plate pack having a first inlet for a first fluid, a first outlet for the first fluid, a second inlet for a second fluid, and a second outlet for the second fluid, wherein the plate pack is configured to direct a flow of the first fluid in thermal contact and exchange heat with a flow of the second fluid; and a frame to compress the plate pack, the frame including:

a head and a follower, the plate pack being disposed between the head and the follower, each of the head and the follower including:

a plurality of interlocking rib cutouts;

a plurality of rib assemblies, each rib assembly including a pair of ribs; and a plurality of tie bar assemblies, each tie bar assembly including:

a tie bar;

a nut; and a tie bar bearing surface to bear upon the rib assembly.

10. The plate heat exchanger according to claim 9, wherein each rib assembly further comprises:

a spacer bush;

a spacer bolt; and a pair of spacer bolt bores disposed in cooperative alignment through the pair of ribs.

11. The plate heat exchanger according to claim 9, wherein each rib includes: a first grip disposed at a first end of the rib; a second grip disposed at a second end of the rib; a first cradle disposed at the first end of the rib; and a second cradle disposed at the second end of the rib, wherein both the first cradle and the second cradle include a cradle bearing surface; and wherein the tie bar bearing surface bears upon the cradle bearing surface.

12. The plate heat exchanger according to claim 9, further comprising:

a pair of pin cutouts disposed in cooperative alignment through the pair of ribs; and a pin configured to mate with the pair of pin cutouts to capture a tie bar between the pair of ribs.

13. The plate heat exchanger according to claim 11, wherein each tie bar assembly further comprises:

a tightening nut having a threaded bore to mate with a threaded portion of the tie bar and the tightening nut having the tie bar bearing surface to bear upon the cradle bearing surface; and a location washer having an unthreaded bore for sliding communication with the tie bar and the location washer having the tie bar bearing surface to bear upon the cradle bearing surface.

14. The plate heat exchanger according to claim 9, wherein each of the head and the follower further comprises:

a first interlocking cutout disposed at a first portion of the interlocking rib cutout, the first interlocking cutout being configured to mate with the first grip;

a second interlocking cutout disposed at a second portion of the interlocking rib cutout, the second interlocking cutout being configured to mate with the second grip; and a tie bar cutout disposed between the first interlocking cutout and the second interlocking cutout, the tie bar cutout being configured to provide a passage for the tie bar.

15. The plate heat exchanger according to claim 9, wherein each of the head and the follower further comprises:

a top tie bar cutout disposed at a top portion of the head and the follower, the top tie bar cutout being in cooperative alignment and configured to mate with respective mating surfaces of a top tie bar; and a bottom tie bar cutout disposed at a bottom portion of the head and the follower, the bottom tie bar cutout being in cooperative alignment and configured to mate with respective mating surfaces of a bottom tie bar.

16. The plate heat exchanger according to claim 15, wherein each of the head and the follower further comprises:

a top side bar cutout disposed proximal to the top portion of the head and the follower, the top side tie bar cutout being in cooperative alignment and configured to mate with respective mating surfaces of a top side tie bar; and a bottom side tie bar cutout disposed proximal to the bottom portion of the head and the follower, the bottom side tie bar cutout being in cooperative alignment and configured to mate with respective mating surfaces of a bottom side tie bar.

17. A method of compressing a plate pack in a frame of a plate heat exchanger, the method comprising the steps of:

disposing the plate pack between a head and a follower, each of the head and the follower including:

a plurality of interlocking rib cutouts;

disposing a plurality of rib assemblies on an outside face of the head and a corresponding plurality of rib assemblies on an outside face of the follower in cooperative alignment with the plurality of rib assemblies on the outside face of the head, each rib assembly including:

a pair of ribs, each rib including: a first grip disposed at a first end of the rib; a second grip disposed at a second end of the rib; a first cradle disposed at the first end of the rib; and a second cradle disposed at the second end of the rib, wherein both the first cradle and the second cradle include a cradle bearing surface; and compressing the plate pack between the head and the follower with a plurality of tie bar assemblies, each tie bar assembly including:

a tie bar;

a nut; and a tie bar bearing surface to bear upon the cradle bearing surface, wherein the plate pack is compressed between the head and the follower by tightening the nut of each tie bar assembly.

18. The method according to claim 17, wherein each rib assembly further comprises:

a spacer bush;

a spacer bolt; and a pair of spacer bolt bores disposed in cooperative alignment through the pair of ribs.

19. The method according to claim 17, further comprising:

capturing the tie bar between the pair of ribs with a pin mated to a pair of pin cutouts disposed in cooperative alignment through the pair of ribs.

20. The method according to claim 17, wherein each tie bar assembly further comprises:

a tightening nut having a threaded bore to mate with a threaded portion of the tie bar and the tightening nut having the tie bar bearing surface to bear upon the cradle bearing surface; and a location washer having an unthreaded bore for sliding communication with the tie bar and the location washer having the tie bar bearing surface to bear upon the cradle bearing surface.

* * * * *